United States Patent [19]

Tojo et al.

[11] 4,216,661

[45] Aug. 12, 1980

[54] SCROLL COMPRESSOR WITH MEANS FOR END PLATE BIAS AND COOLED GAS RETURN TO SEALED COMPRESSOR SPACES

[75] Inventors: Kenji Tojo, Ibaraki; Hirokatu Kousokabe, Yokohama; Nobukatsu Arai, Ushikumachi; Eiji Sato, Shimoinayoshi, all of Japan

[73] Assignee: Hitachi, Ltd., Japan

[21] Appl. No.: 967,893

[22] Filed: Dec. 8, 1978

[30] Foreign Application Priority Data

Dec. 9, 1977 [JP] Japan ..... 52/147096

[51] Int. Cl.[2] ..... F25B 31/00; F04C 17/02; F04C 29/00

[52] U.S. Cl. ..... 62/505; 418/15; 418/55; 418/57; 418/151; 418/180

[58] Field of Search ..... 418/15, 55, 57, 151, 418/180; 62/505

[56] References Cited

U.S. PATENT DOCUMENTS

| | | | |
|---|---|---|---|
| 1,893,171 | 1/1933 | Kagi | 418/15 |
| 2,841,089 | 7/1958 | Jones | 418/55 |
| 3,600,114 | 8/1971 | Dvorak | 418/55 |
| 3,874,827 | 4/1975 | Young | 418/55 |
| 3,884,599 | 5/1975 | Young et al. | 418/55 |
| 3,913,346 | 10/1975 | Moody, Jr. et al. | 62/505 |
| 3,994,633 | 11/1976 | Shaffer | 418/55 |
| 4,049,410 | 9/1977 | Miller | 62/505 |

*Primary Examiner*—John J. Vrablik

*Attorney, Agent, or Firm*—Craig & Antonelli

[57] ABSTRACT

In a gas pressure increasing system for increasing the pressure of a refrigerant gas or air having a scroll compressor, a condenser, a pressure reducing means and an evaporator or a scroll compressor and a gas cooler, an exhaust gas released from the scroll compressor after having its pressure increased by the scroll compressor itself is cooled and expanded to reduce its pressure to an intermediate pressure level to produce a gas of an intermediate pressure having a cooling capability. The gas of the intermediate pressure is used to provide a force for axially sealing an orbiting scroll member of the scroll compressor as well as to cool the scroll compressor and a motor.

7 Claims, 5 Drawing Figures

SCROLL COMPRESSOR WITH MEANS FOR END PLATE BIAS AND COOLED GAS RETURN TO SEALED COMPRESSOR SPACES

BACKGROUND OF THE INVENTION

1. Field of the Invention

This invention relates to gas pressure increasing systems including a freezing apparatus, a refrigerating apparatus and an air conditioning system using a scroll compressor as a compressor means and an apparatus in which air or other gas is compressed by a scroll compressor to increase its pressure.

2. Description of the Prior Art

A scroll compressor has been used as a compressor means of a gas pressure increasing system including a compressor means, a condenser, an expanding or pressure reducing means and an evaporator or a gas pressure increasing system including a compressor means and a gas cooler.

A scroll comressor comprises an orbiting scroll member and a fixed scroll member, the orbiting scroll member including an end plate and a wrap formed primarily in an involute curve and attached to one surface of the end plate in an upstanding position and the fixed scroll member including an end plate, a wrap formed primarily in an involute curve and attached to one surface of the end plate in an upstanding position, a suction port and an exhaust port. The orbiting scroll member and fixed scroll member are arranged in juxtaposed relation with the wraps thereof being fitted closely together, and the orbiting scroll member is moved in orbiting motion by a drive shaft from a motor while the rotation of the orbiting scroll member on its own axis is inhibited by an Oldham's ring interposed between the orbiting and fixed scroll members or between the orbiting scroll member and a housing. The orbiting movement of the orbiting scroll member reduces sealed spaces defined between the two scroll members and compresses a gas therein to increase its pressure.

A scroll compressor, an expanding machine and a pump having the aforesaid construction are disclosed in U.S. Patent No. 3,884,599.

In a scroll compressor, and expanding machine and a pump (hereinafter generally referred to as scroll fluid apparatus), the pressure of a gas in the sealed spaces defined between the orbiting scroll member and fixed scroll member becomes high as portions of the wraps of the two scroll members in contact with each other approach the center of each wrap. This increase in pressure occurs periodically during the orbiting movement of the orbiting scroll member, so that a force urging the two scroll member away from each other is produced between them. In the event the two scroll members being separated from each other by such force, gaps will be produced between the tops of the wraps and the two end plates, and an axial seal will not be provided satisfactorily. The result of this is that a leakage of gas through the gaps will increase and the efficiency of the scroll fluid apparatus will be reduced.

In order to provide a satisfactory axial seal, U.S. Patent No. 2,841,089 proposes to use compression springs mounted between a surface of the orbiting scroll member which is opposite to the surface provided with a wrap and a housing to urge the orbiting scroll member to move toward the fixed scroll member. In U.S. Patent No. 3,600,114, an exhaust gas from an exhaust gas line of the scroll compressor is introduced into a space formed on a surface of the orbiting scroll member which is opposite to the surface provided with a wrap so as to bring the pressure of the exhaust gas of the compressor itself to bear upon the orbiting scroll member. U.S. Patent No. 3,884,599 provides means for applying the pressure of an exhaust gas of the scroll compressor itself and the pressure of a spring to the orbiting scroll member.

Some disadvantages are associated with the aforementioned proposals of the prior art made for the purpose of providing a satisfactory axial seal to the orbiting scroll member of a scroll compressor. When the pressure of springs is utilized, springs should be mounted between a movable part (orbiting scroll member) and a stationary part (housing), resulting in an increase in the area of the sliding portion and an attendant frictional loss. Also, since the force imparted by springs is substantially constant, a large imbalance would occur between the force urging the two scroll members away from each other and the force imparted by the springs when the pressure of a gas in the sealed spaces is low, such as the time of starting. Owing to such imbalance, the frictional dragging of the orbiting scroll member on the fixed scroll member would be great and consequently the starting torque would become very high.

The use of the pressure of an exhaust gas from an exhaust gas line of the scroll compressor itself would have the disadvantage that if the pressure of the exhaust gas is applied directly or indirectly to the surface of the orbiting scroll member which is opposite to the surface provided with a wrap, an axial force far greater than a force necessary for providing an axial seal (which is slightly greater than a force urging the two scroll members away from each other) would be produced, thereby increasing a frictional loss between the two scroll members. This would necessitate the provision of means for limiting the pressure receiving area to a low level which would in turn render the construction of the scroll compressor complex.

In each of the prior art referred to hereinabove, means for producing a force necessary for providing an axial seal are described by referring to various embodiments as examples. However, there is not expressly mentioned therein a means of removing heat which would be produced by compression and friction as well as the heat produced by an electric motor.

SUMMARY OF THE INVENTION

An object of this invention is to provide a gas pressure increasing system having a scroll compressor which is capable of exerting an optimum axial sealing force on an orbiting scroll member and of minimizing a rise in the temperature of a compressed gas and the scroll eompressor.

Another object is to provide a gas pressure increasing system having a scroll compressor of simple construction.

Still another object is to provie a gas pressure increasing system havin a scroll compressor which is capable of cooling an electric motor in addition to exerting an optimum axial sealing force on an orbiting scroll member and avoiding a rise in the temperature of a compressed gas and the scroll compressor of the hermetic type.

The aforementioned objects can be accomplished, in a closed gas pressure increasing system having at least a scroll compressor, a condenser, an expanding and pressure reducing means and an evaporator and an open gas pressure increasing system having at least a scroll compressor and a gas cooler, by drawing off a gas from the outlet side of the condenser or gas cooler and applying such gas to a surface of an orbiting scroll member of the scroll compressor which is opposite to the surface provided with a wrap after reducing the pressure of the gas to an intermediate pressure level by pressure reducing means, and by introducing the gas applied to said opposite surface of the orbiting scroll member into sealed spaces between the wraps of the scroll compressor, by way of passage means, in which the pressure of a gas is near said intermediate pressure level because said sealed spaces are in process of contraction, whereby the introduced gas can be mixed with the uncompressed gas in the sealed spaces which is in process of compression.

BRIEF DESCRIPTION OF THE DRAWINGS

FIG . 4 is a vertical sectional view of a scroll compressor arranged as a component of a closed gas pressure increasing system, in explanation of another modification of the manner in which the invention is practised.

DETAILED DESCRIPTION OF THE PREFERRED EMBODIMENTS

Figure 1:
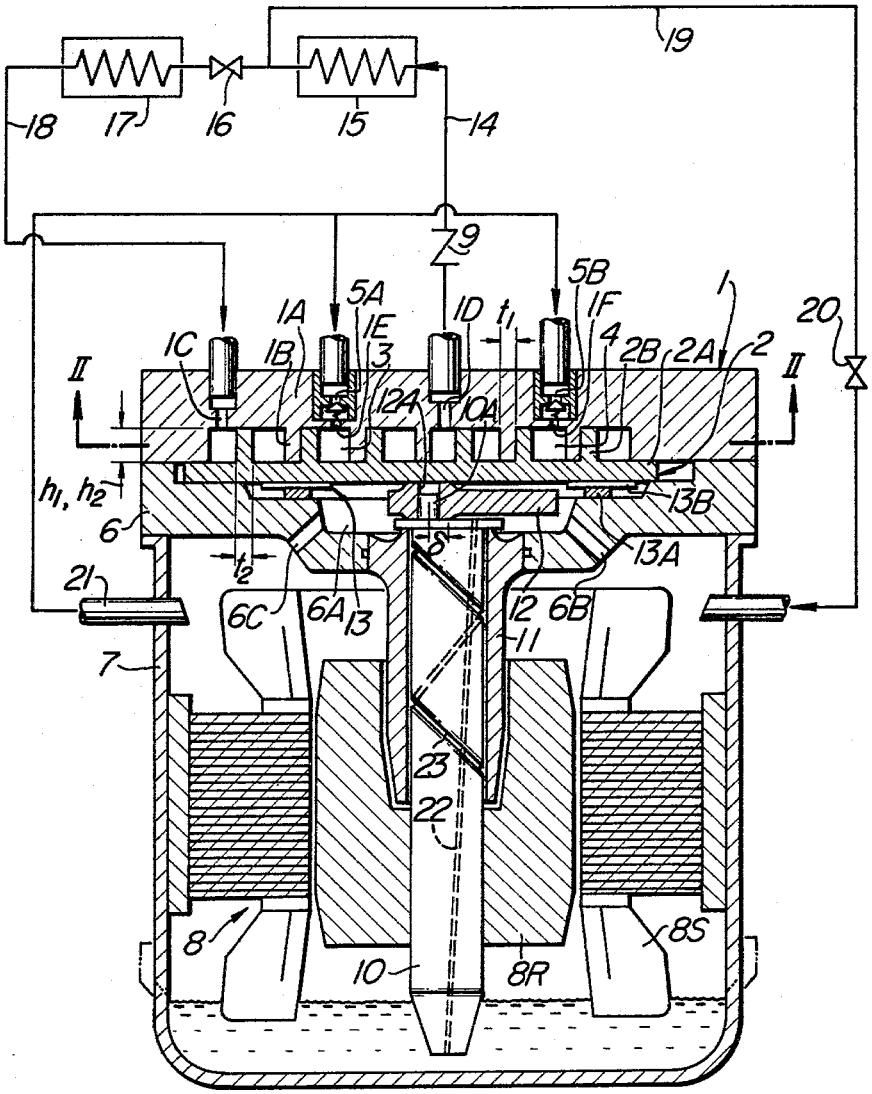
FIG. 1 is a vertical sectional view of a scroll compressor arranged as a component of a closed gas pressure increasing system, in explanation of the manner in which the present invention is practised.
Figure 2:
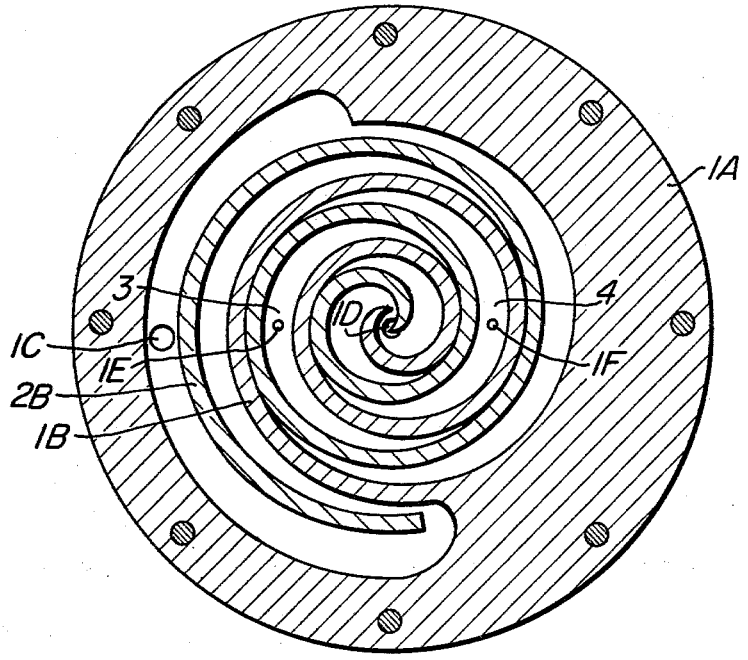
FIG. 2 is a transverse sectional view taken along the line II—II in FIG. 1.

FIG. 1 is a vertical sectional view of a scroll compressor arranged in a closed gas pressure increasing system, in explanation of the manner in which the invention is practised, and FIG. 2 is a transverse sectional view taken along the line II—II in FIG. 1. The term "closed gas pressure increasing system" as used herein is defined as including constituting parts dealing with the refrigeration cycle of a freezing apparatus (cooling apparatus), a refrigerating apparatus and an air conditioning system.

A fixed scroll member 1 includes an end plate 1A, and a wrap 1B arranged in an upstanding position on the end plate 1A in an involute curve or a curve closely resembling the involute curve and having a height $h_1$ and a thickness $t_1$ which are substantially uniform. The fixed scroll member 1 is formed with a suction port 1C in a position which is close to the terminating end of the wrap 1B near the outer periphery thereof and with an exhaust port 1D in a position which is close to the commencing end of the wrap 1B in the central portion of the member 1.

An obiting scroll member 2 includes an end plate 2A, and a wrap 2B arranged in an upstanding position on the end plate 2A in an involute curve or a curve closely resembling the involute curve and having a height $h_2$ and a thickness $t_2$ which are substantially uniform. The thickness $t_2$ of the wrap 2B is equal to the thickness $t_1$ of the wrap 1B of the fixed scroll member 1 as shown. However, the thicknesses $t_1$ and $t_2$ of the two wraps 1B and 2B may be varied from each other. The height $h_2$ of the wrap 2B of the orbiting scroll member 2 is equal to the height $h_1$ of the wrap 1B of the fixed scroll member 1.

Besides the suction port 1C and the exhaust port 1D, at least two communicating ports 1E and 1F are formed in the end plate 1A of the fixed scroll member 1 to communicate with sealed spaces 3 and 4 between the wraps 1B and 2B respectively which are maintained at a pressure intermediate between the exhaust pressure and the suction pressure. Mounted in the communicating ports 1E and 1F are check valves 5A and 5B respectively which open when the pressure in a chamber means 7 introduced through a communicating conduit 21 to said check valves is higher than the pressure in the sealed spaces 3 and 4 and close when the former pressure is lower than the latter pressure. The communicating conduit 21 and chamber means 7 are subsequently to be described.

A housing 6 has a housing chamber 6A communicating with outside through at least two communicating ducts 6B and 6C and is maintained at its outer marginal portion in intimate contact with the end plate 1A of the fixed scroll member 1. The housing 6 and fixed scroll member 1 are bolted together, not shown.

The chamber means 7 is joined by welding or connected by bolts to the housing 6 to cooperate therewith in providing a chamber. Although the chamber means 7 is shown to be unitary in structure, it may comprise, as shown in broken lines in FIG. 1, a cylindrical portion and a pan-shaped portion connected together as a unit.

A motor 8 has a stator 8S secured to an inner wall surface of the chamber means 7 and a rotor 8R secured to a drive shaft 10 which is rotatably supported by a bearing 11 mounted such that the center of the bearing coincides with the center of the wrap 1B of the fixed scoll member 1. The drive shaft 10 has attached to its upper end an eccentric pin 10A in a position which deviates by $\delta$ from the center of the drive shaft 10, the pin 10A being fitted in an engaging port 12A formed in a balancing weight 12 attached to the surface opposite to the surface provided with the wrap 2B of the orbiting scroll member 2. The center of the engaging port 12A coincides with the center of the wrap 2B of the orbiting scroll member 2.

Alternatively, the balancing weight 12 may be attached to the drive shaft 10 and the pin 10A may be attached to the orbiting scroll member 2.

Means 13 for preventing the rotation of the revolving scroll member 2 on its own axis is interposed between the orbiting scroll member 2 at its surface opposite to the surface provided with the wrap 2B and the housing 6 and comprises an Oldham's ring 13A and at least two sets of key members 13B (only one set is shown in FIG. 1 which is a vertical sectional view). The Oldham's ring 13A is formed on one side thereof with a groove which is at right angles to a groove formed on the other side thereof. One of a set of key members 13B is bolted to the opposite surface of the orbiting scroll member 2 and engaged in one groove of the Oldham's ring, while the other key member (not shown) is bolted to the housing 6 and engaged in the other groove of the Oldham's ring.

An exhaust conduit 14 mounting a check valve 9 therein (in some cases this valve may be omitted) is connected at one end thereof to the exhaust port 1D and at the other end thereof to a condenser 15. A pressure reducing means 16, such as an expanding and pressure reducing valve, capillary tube, etc., is located on the outlet side of the condenser 15, and an evaporator 17 is located on the outlet side of the pressure reducing means 16. The evaporator 17 is connected at its outlet side to the suction port 1C through a suction conduit 18. Connected midway between the condenser 15 and the pressure reducing means 16 at one end is a branch conduit 19 which is connected at the other end to the chamber means 7, with a pressure reducing means 20 for reducing the pressure of a gas to an intermediate pressure level (between the suction pressure and the exhaust pressure) being mounted in the branch conduit 19. The communicating conduit 21 communicates the chamber in the chamber means 7 with the communicating ports 1E and 1F of the fixed scroll member 1. An eccentric though bore 22 which has a lower end disposed in a position coinciding with the center axis of the shaft 10 and an upper end disposed in a position which deviates from the center axis thereof is formed in the drive shaft 10 for supplying under pressure lubricating oil from the bottom of the chamber means 7 to various parts. A spiral groove 23 is formed on the drive shaft 10 in a portion thereof which is juxtaposed against the bearing 11 for the drive shaft 10.

In operation, a current is passed through a cable, not shown, to the coil of the stator 8S to start the motor 8, and rotate the drive shaft 10. The rotation of the drive shaft 10 causes the pin 10A to move in circular motion with a radius $\delta$ which causes the orbiting scroll member 2 to move in orbiting movement with a radius $\delta$. The result of this is that the sealed spaces 3 and 4 move toward the center of the wraps 1B and 2B as the lines of contact of the wraps 1B and 2B move. By this movement of the orbiting scroll member 2, a refrigerant gas is drawn from the suction conduit 18 through the suction port 1C into between the two scroll members 1 and 2 and released, after being compressed, through the exhaust port 1D. After being released, the compressed exhaust gas flows through the check valve 9 into the condenser 15 where the refrigerant gas is cooled with air or cooling water into a liquid form. The liquefied refrigerant has its pressure reduced when it passes through the pressure reducing means 16 and flows into the evaporator 17 where the liquid refrigerant changes into a gaseous form as it evaporates by absorbing the latent heat of evaporation from the surrounding air. The refrigerant gas is drawn through the suction conduit 18 by the scroll compressor again.

Meanwhile a portion of the liquid refrigerant obtained in the condenser 15 flows through the branch conduit 19, has its pressure reduced in the pressure reducing means 20 mounted midway in the conduit 19 to reduce its pressure to an intermediate pressure level, and flows into the chamber of the chamber means 7. The refrigerant flowing into the chamber means 7 is in mingling vapor and liquid form and required the latent heat of vaporization when the liquid refrigerant evaporates, so that the refrigerant gas in the chamber means 7 is kept at a lower temperature than the refrigerant before being introduced into the chamber means 7. A portion of the refrigerant gas kept at a low temperature passes through the communicating ducts 6B and 6C to the housing chamber 6A to cool the orbiting scroll member 2 through the opposite surface of the end plate 2A thereof and at the same time to apply a surface pressure of the intermediate pressure level to that surface of the end plate 2A.

The refrigerant gas in the chamber means 7 flows through the communicating conduit 21 to the communicating ports 1E and 1F of the fixed scroll member 1 through which the refrigerant gas flows into the sealed spaces 3 and 4 by opening the check valves 5A and 5B respectively when the pressure in the sealed spaces 3 and 4 is lower than the pressure in the chamber means 7. Being lower in temperature than the refrigerant gas in process of compression in the sealed spaces 3 and 4, the refrigerant gas introduced from the chamber means 7 cools and reduces the temperature of the refrigerant in the sealed spaces 3 and 4. The sealed spaces 3 and 4 are reduced in volume while they are maintained in communication with the communicating ports 1E and 1F respectively, so that the pressure in the spaces rises. However, the revolution of the orbiting scroll member 2 through a small angle results in the communicating ports 1E and 1F communicating with freshly formed sealed spaces adjacent to said sealed spaces 3 and 4, and the pressure of the refrigerant gas in said adjacent sealed spaces is low. Thus the pressure in the communicating ports 1E and 1F repeatedly rises and falls, so that the check valves 5A and 5B perform the function of inhibiting the return flow of the refrigerant gas of high pressure in the sealed spaces 3 and 4 into the chamber means 7 through the communicating contuit 21.

Figure 3:
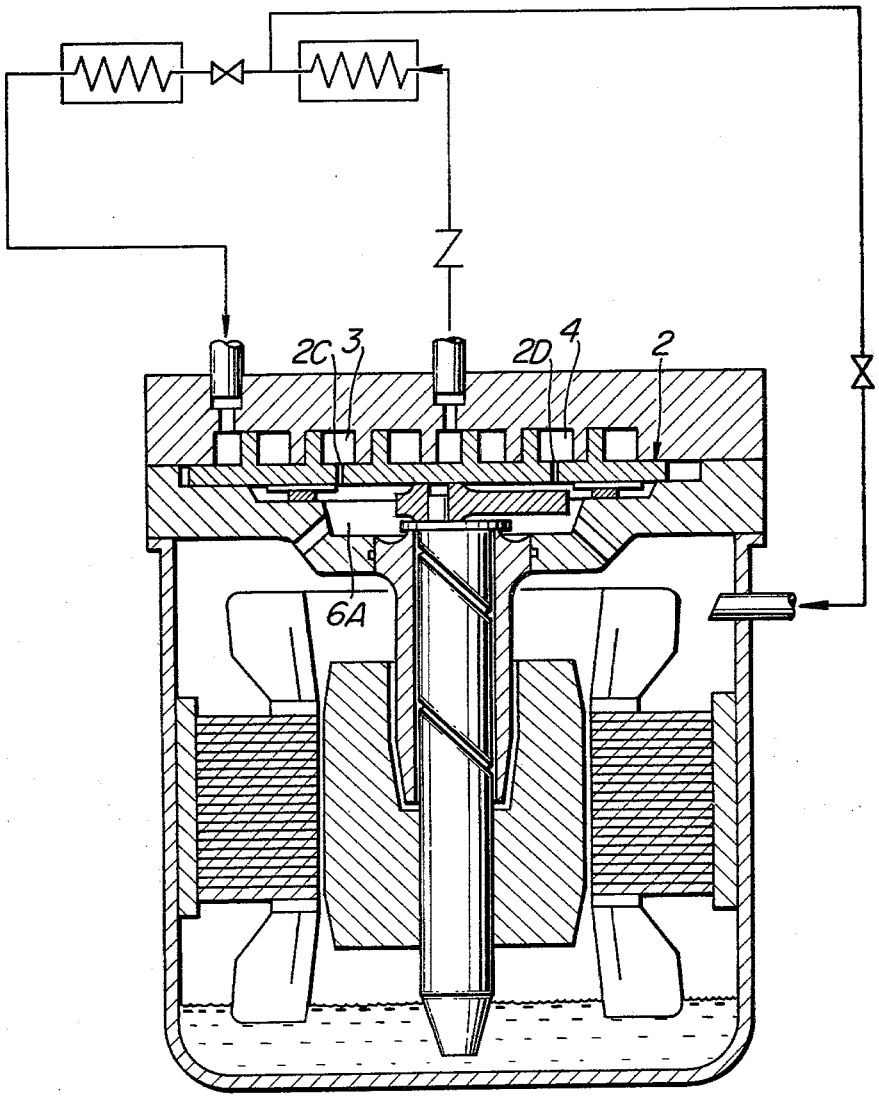
FIG. 3 is a vertical sectional view of a scroll compressor arranged as a component of a closed gas pressure increasing system, in explanation of a modification of the manner in which the invention is practised.

FIG. 3 shows a modification of the manner in which the invention is practised. The system shown in FIG. 3 is distinct from the system shown in FIGS. 1 and 2 in that the communicating ports 1E and 1F, check valves 5A and 5B and communicating conduit 21 are eliminated and communicating ports 2C and 2D are formed in the orbiting scroll member 2. The communicating ports 2C and 2D, which are formed in positions communicating with the sealed spaces 3 and 4 in which the pressure of the refrigerant gas is intermediate between the suction pressure and the exhaust pressure, are sufficiently small in diameter to effectively perform the function of throttling the refrigerant gas flowing therethrough. The system shown in FIG. 3 is similar to the system shown in FIGS. 1 and 2 in other respects.

In operation, the refrigerant gas of low temperature in the housing chamber 6A flows through the communicating ports 2C and 2D into the sealed spaces 3 and 4 to cool the refrigerant gas in process of compression. Except the foregoing, the system shown in FIG. 3 operates in the same manner as the system shown in FIGS. 1 and 2. The system shown in FIG. 3 offers the advantage that the external tubing (communicating conduit 21) can be dispensed with, although a small quantity of the refrigerant gas in process of compression may flow through the communicating ports 2C and 2D into the housing chamber 6A.

Figure 4:
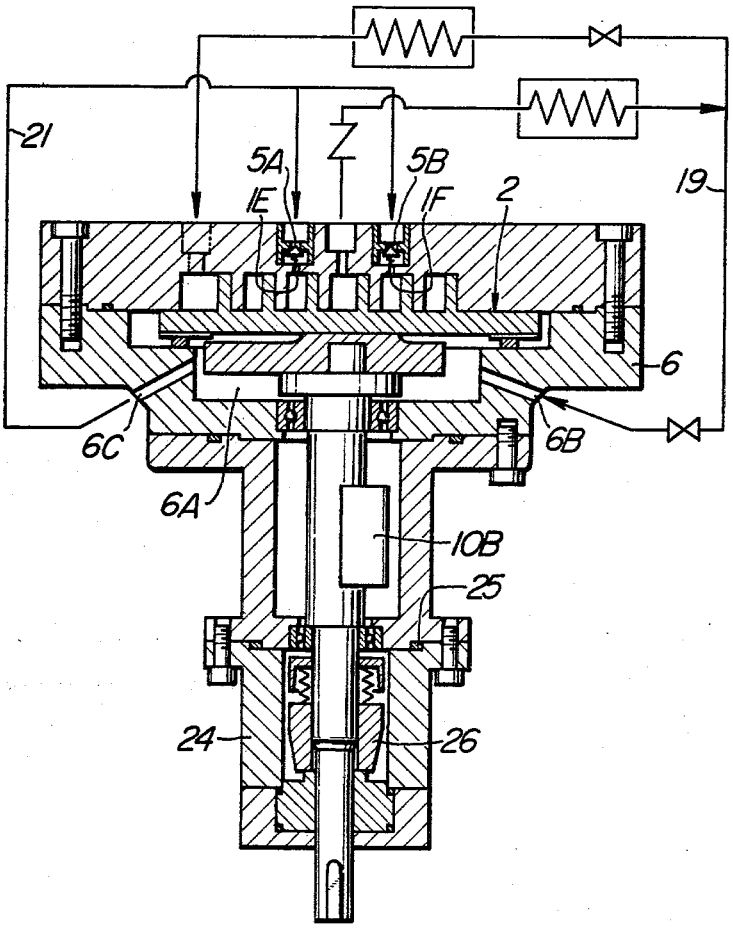

FIG. 4 shows another modification of the manner in which the invention is practised. The system shown in FIG. 4 is substantially similar to the systems shown in FIGS. 1 and 2 and FIG. 3 except that the motor 8 is located outside the chamber means 7 and that the other end of the branch conduit 19 is connected to the communicating duct 6B of the housing 6 and the end of the commmunicating conduit 21 is connected to the communicating duct 6C thereof. The motor 8 may be of the type which is commercially available.

The housing 6 has bolted thereto through a seal ring 25 a seal housing 24 containing therein a mechanical seal 26 to keep the housing chamber 6A airtight. 10B designates a counter weight.

In the system shown in FIG. 4, the communicating conduit 21, communicating ports 1E and 1F, communicating duct 6C and check valves 5A and 5B may be removed or dispensed with and the communicating ports 2C and 2D may be formed as described by referring to FIG. 3.

The system shown in FIG. 4 and its modification are substantially similar in operation to the systems shown in FIGS. 1 and 2 and FIG. 3.

Figure 5:
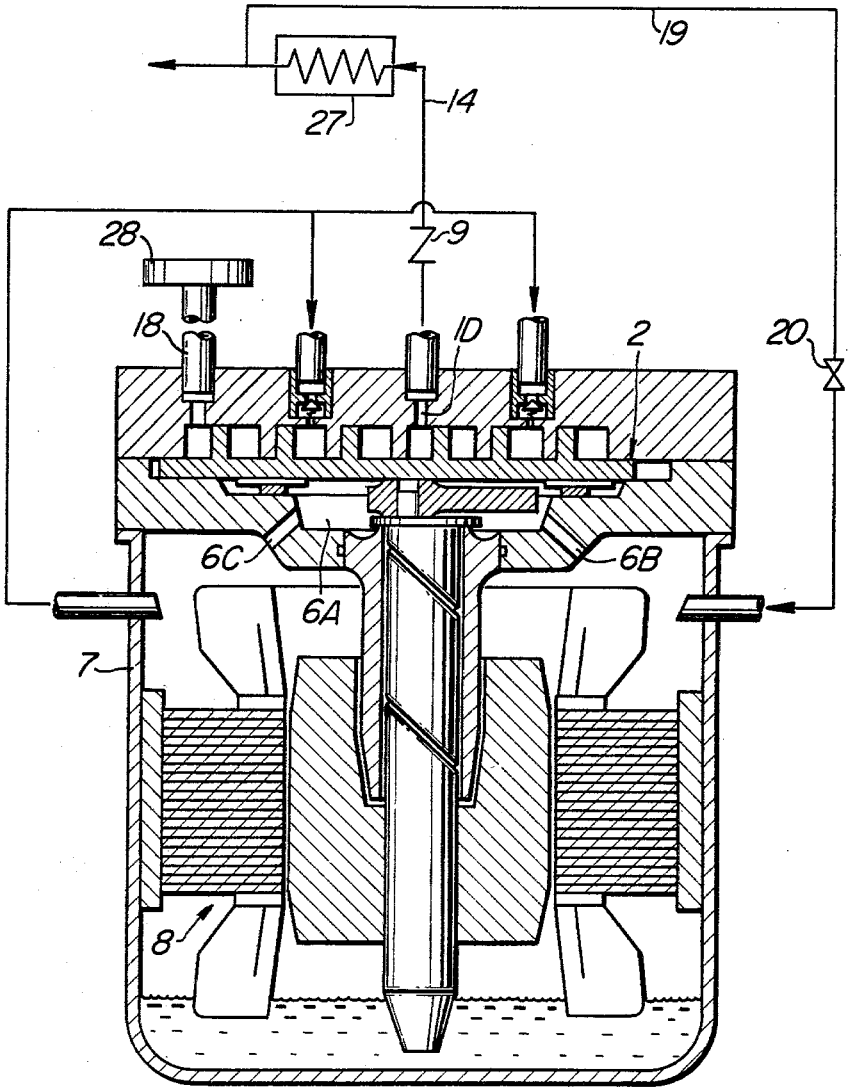
FIG. 5 is a vertical sectional view of a scroll compressor arranged as a component of an open gas pressure increasing system, in explanation of a further modification of the manner in which the invention is practised.

FIG. 5 shows the manner in which the invention is applied to an open gas pressure increasing system in which the condenser 15 shown in FIGS. 1, 3 and 4 is replaced by a gas cooler 27, the pressure reducing means 16 and evaporator 17 are removed, and a filter 28 is additionally mounted at the inlet of the suction conduit 18.

In the system shown, compressed air released through the exhaust port 1D is introduced through the exhaust conduit 14 and check valve 9 into the gas cooler 27 where it is cooled by cooling water or air before being delivered to its destination. A portion of the compressed gas is passed, immediately after being released from the gas cooler 27, through the branch conduit 19 and has its pressure reduced to an intermediate pressure level in the pressure reducing means 20 midway through the branch conduit 19, before flowing into the chamber means 7 to cool the motor 8 to prevent its overheating. A portion of the air in the chamber means 7 flows through the communicating ducts 6B and 6C into the housing chamber 6A to exert an axially sealing force on the surface opposite to the surface provided with the wrap 2B of the end plate 2A of the orbiting scroll member 2. Since the air flowing into the housing chamber 6A has a low temperature because it is cooled in the gas cooler 27 and subjected to adiabatic expansion in the pressure reducing means 20, it is possible to maintain at a low temperature not only the interior of the chamber means 7 but also the interior of the housing chamber 6A.

As described hereinabove by referring to various embodiments, a cooled gas of an intermediate pressure level is caused to act on the surface opposite to the surface provided with the wrap of the end plate of an orbiting scroll member in the invention, so that an axially sealing force slightly greater in magnitude than the force acting on fixed and orbiting scroll members to move them away from each other while the pressure of gas therein is being increased, can be exerted on said surface of the orbiting scroll member. Thus it is possible to provide an optimum axial seal to the scroll members. Also, the interior of a chamber means and/or a housing chamber can be filled with a gas of low temperature. This can achieve the effect of cooling a motor housed in said chamber means and the orbiting scroll member to prevent their overheating.

What is claimed is:

1. A gas pressure increasing system having at least a scroll compressor, an exhaust conduit, a condenser, a pressure reducing means, an evaporator and a suction conduit, said scroll compressor comprising:

a fixed scroll member including an end plate, a wrap attached to one surface of said end plate in an upstanding position and primarily formed in an involute curve, an exhaust port formed in said end plate in a position close to a commencing end of said wrap, and a suction port formed in said end plate in a position close to a terminating end of said wrap;

an orbiting scroll member including an end plate, and a wrap attached to one surface of said end plate in an upstanding position and primarily formed in an involute curve, said orbiting scroll member and said fixed scroll member being arranged in juxtaposed relation with the wraps thereof being fitted closely together;

means for inhibiting the rotation of said orbiting scroll member on its own axis;

a housing means attached to said surface of said end plate of said fixed scroll member which has said wrap and including a housing chamber for containing therein said orbiting scroll member, said housing means being formed with at least two communicating ducts;

at least one bearing secured to said housing means;

a drive shaft supported by said bearing;

a balancing weight;

a pin attached to said drive shaft in a position remote from the center axis of said drive shaft for transmitting the rotation of said drive shaft from said positon to said orbiting scroll member as an orbiting motion; and a motor connected to said drive shaft;

wherein the improvement comprises:

a branch conduit branching, at one end thereof, off a refrigerant path from a point therein immediately posterior to the condenser and mounting a pressure reducing means midway thereof for reducing the pressure of a refrigerant to an intermediate pressure level and expanding the same so as to cause the refrigerant in the form of a gas of an intermediate pressure level to act on a surface opposite to the surface provided with said wrap of said end plate of said orbiting scroll member of said scroll compressor; and means for returning the refrigerant in the form of a gas acting on said opposite surface of said orbiting scroll member of said scroll compressor to sealed spaces of an intermediate pressure level defined between said fixed scroll member and said orbiting scroll member.

2. A gas pressure increasing system having at least a scroll compressor, an exhaust conduit and a gas cooler, said scroll compressor comprising:

a fixed scroll member including an end plate, a wrap attached to one surface of said end plate in an upstanding position and primarily formed in an involute curve, an exhaust port formed in said end plate in a position close to a commencing end of said wrap, and a suction port formed in said end plate in a position close to a terminating end of said wrap;

an orbiting scroll member including an end plate, and a wrap attached to one surface of said end plate in an upstanding position and primarily formed in an involute curve, said orbiting scroll member and said fixed scroll member being arranged in juxtaposed relation with the wraps thereof being fitted close together;

means for inhibiting the rotation of said orbiting scroll member on its own axis;

a housing means attached to said surface of said end plate of said fixed scroll member which has said wrap and including a housing chamber for containing therein said orbiting scroll member, said housing means being formed with at least two communicating ducts;

at least one bearing secured to said housing means;

a drive shaft supported by said bearing;

a balancing weight;

a pin attached to said drive shaft in a position remote from the center axis of said drive shaft for transmitting the rotation of said drive shaft from said position to said orbiting scroll member as an orbiting motion; and a motor connected to said drive shaft;

wherein the improvement comprises:

a branch conduit branching, at one end thereof, off a gas path from a point therein immediately posterior to the gas cooler and mounting a pressure reducing means midway thereof for reducing the pressure of a compressed gas to an intermediate pressure level and expanding the same so as to cause the compressed gas of an intermediate pressure level to act on a surface opposite to the surface provided with said wrap of said end plate of said revolving scroll member of said scroll compressor; and means for returning the compressed gas acting on said opposite surface of said orbiting scroll member of said scroll compressor to sealed spaces of an intermediate pressure level defined between said fixed scroll member and said orbiting scroll member.

3. A gas pressure increasing system as set forth in claim 1 or 2, further comprising a chamber means connected to said housing means and having a stator of said motor secured thereto, a rotor of said motor being fixed to said drive shaft, and wherein said branch conduit is connected at the other end thereof to said chamber means.

4. A gas pressure increasing system as set forth in claim 3, wherein said gas returning means comprises at least two communicating ports formed in said fixed scroll member of said scroll compressor in positions communicating with said sealed spaces of the intermediate pressure level, and a communicating conduit means communicating said chamber means with said communicating ports of said fixed scroll member of said scroll compressor.

5. A gas pressure increasing system as set forth in claim 3, wherein said gas returning means comprises at least two communicating ports formed in said orbiting scroll member of said scroll compressor for communicating said sealed spaces of the intermediate pressure level with said housing chamber of said housing means.

6. A gas pressure increasing system as set forth in claim 4, wherein said communicating ports formed in said fixed scroll member of said scroll compressor each have a check valve mounted therein.

7. A gas pressure increasing system as set forth in claim 1 or 2, wherein said gas returning means comprises at least two communicating ports formed in said fixed scroll member of said scroll compressor, and a communicating conduit means communicating said communicating ports of said fixed scroll member with one of said communicating ducts of said housing means, the other communicating duct of said housing means connected to said branch conduit at the other end thereof.

* * * * *